US005116149A

United States Patent [19]

Yamasaki

[11] Patent Number: 5,116,149

[45] Date of Patent: May 26, 1992

[54] PRINTER FOR REDUCING PRINTING OPERATION TIME

[75] Inventor: Keiichi Yamasaki, Kurume, Japan

[73] Assignee: Matsushita Electric Industrial Co., Ltd., Osaka, Japan

[21] Appl. No.: 579,232

[22] Filed: Sep. 6, 1990

Related U.S. Application Data

[63] Continuation of Ser. No. 256,790, Oct. 12, 1988, abandoned.

[30] Foreign Application Priority Data

Oct. 14, 1987 [JP] Japan ..... 62-258915

[51] Int. Cl.[5] ..... B41J 19/94

[52] U.S. Cl. ..... 400/314.1; 400/279

[58] Field of Search ..... 400/279, 320, 322, 323, 400/314, 314.1, 568

[56] References Cited

U.S. PATENT DOCUMENTS

| | | | |
|---|---|---|---|
| 3,970,183 | 7/1916 | Robinson | 400/323 |
| 4,179,223 | 12/1979 | Kwan | 400/323 |
| 4,180,335 | 12/1979 | Yamada | 400/322 |
| 4,469,460 | 9/1989 | Hughes | 700/322 |
| 4,761,085 | 8/1988 | Angst | 400/322 |
| 4,976,555 | 12/1990 | Ueyama | 400/322 |

FOREIGN PATENT DOCUMENTS

| | | | |
|---|---|---|---|
| 220779 | 12/1983 | Japan | 400/314 |
| 22765 | 2/1984 | Japan | 400/314 |
| 40277 | 3/1985 | Japan | 400/322 |
| 54971 | 3/1986 | Japan | 400/314.1 |
| 284775 | 12/1987 | Japan | 400/314 |

*Primary Examiner*—David A. Wiecking
*Assistant Examiner*—Steven S. Kelley
*Attorney, Agent, or Firm*—Spencer, Frank & Schneider

[57] ABSTRACT

A printer comprises a sheet feeding device for starting to feed a printing sheet to the position of the next line immediately after data of one line is completely printed and deceleration of a carriage from a predetermined printing speed is started, a control table preparing device for storing drive control information for the next line in a control table as soon as the data of the one line is completely printed and deceleration of the carriage from the printing speed is started, a first computing device for computing a first period of time required from the completion of printing of the data of the one line until the carriage starts its movement from its stopped state in the direction opposite to the direction of movement of the carriage during printing the data of the one line and reaches a printing enable speed so that data of the next line can be printed, a second computing device for computing, from the time the carriage is stopped, and a second period of time required until the operation of the sheet feeding device is completed, the second computing device continuing to compute the second period of time whenever the carriage is stopped, and a control device comparing the second period of time with the first period of time whenever the carriage is stopped and starting the acceleration of the carriage each time the second period of time becomes less than the first period of time.

2 Claims, 7 Drawing Sheets

PRINTER FOR REDUCING PRINTING OPERATION TIME

This application is a continuation of application Ser. No. 07/256,790 filed Oct. 12, 1988, now abandoned.

BACKGROUND OF THE INVENTION

1. Field of the Invention

This invention relates to a printer.

2. Description of the Related Art

With office automation, printers are now increasingly used in modern offices. These printers are featured by a low price and an excellent printing performance. It is now strongly demanded to offer a printer which can print characters of high quality at a high printing speed and which has multiple functions. In order to realize such a printer, preparation of software useful for controlling the operation of the printer is quite important.

The operation of a prior art printer will be briefly described before describing the present invention in detail, so that the present invention can be more clearly understood.

FIG. 8 is a timing chart showing the operation timing of an example of the prior art printer. First, in a period A-B, drive control information for controlling the operation of a carriage (not shown) carrying a printing unit so as to print data of one line on a printing sheet (not shown) is stored in a control table. Thus the control table for one line has been prepared. Then, in the next period B-C, the carriage is accelerated according to drive control information stored in the control table until the desired printing speed is attained. The operation of the carriage in the acceleration period is called "starting operation" bellow. In the next period C-D, a plurality of printing pins are selectively projected from a printing head (not shown) included in the printing unit while maintaining the printing speed, thereby printing characters on the printing sheet in a dot matrix pattern. Upon completion of printing of the characters of one line, the carriage is decelerated in the next period D-E, and, at the same time, the printing sheet is fed by an amount corresponding to one line by a line feed motor (not shown). The operation of the carriage in the deceleration period is called "stopping operation" bellow. In the succeeding period E-F, the line feed motor is maintained in a hold state for a predetermined period of time until the vibration of the printing sheet is completely settled. Then, drive control information corresponding to the next line is stored in the control table in the next period F-G. The carriage is then accelerated in the next period G-H until the printing speed is attained, and printing of characters of the next line at the printing speed is executed from time H.

The prior art printer operating in the manner described above is disadvantageous in that, until characters of one line are completely printed, and the printing sheet is then fed to the position of the next line, preparation of the control table storing the drive control information for the next line as well as the starting operation of the carriage cannot be started. Thus, the prior art printer has had the problem that the desired increase in the overall speed of printing operation is difficult to attain. Therefore, it has been strongly demanded to provide a printer in which the line feed from one line to the next and preparation of the control table for storing drive information for the next line can be started simultaneously with the stopping operation of the carriage, so that characters of he next line can be printed as soon as possible.

SUMMARY OF THE INVENTION

It is an object of the present invention to provide a printer in which the period of time required from the end of printing data of one line to the start of printing data of the next line can be greatly shortened.

An embodiment of the printer of the present invention comprises sheet feeding means for starting to feed a printing sheet to the position of the next line immediately after data of one line is completely printed and deceleration of a carriage from a predetermitted printing speed is started, control table preparing means for storing drive control information for the next line in a control table as soon as the data of the one line is completely printed and deceleration of the carriage from the printing speed is started, first computing means for computing a first period of time required until the printing speed is attained again after acceleration of the carriage in a direction opposite to the direction of movement of the carriage during printing the data of the one line, so that data of the next line can now be printed, second computing means for computing, after the carriage is stopped, a second period of time required until the operation of the sheet feeding means is completed from the time of stoppage of the carriage, the second computing means continuing to compute the second period of time whenever the carriage is stopped, and control means comparing the result of computation by the second computing means with the result of computation by the first computing means whenever the carriage is stopped, so that acceleration of the carriage is started again each time the result of computation by the second computing means becomes smaller than the result of computation by the first computing means.

Thus, before the sheet feeding operation is completed after data of one line is completely printed and the carriage is stopped, the starting operation of the carriage can be immediately started, so that the period of time required for starting to print data of the next line after the end of printing the data of the preceding line can be greatly shortened.

BRIEF DESCRIPTION OF THE DRAWINGS

FIG. 2 is a system block diagram showing the structure of the printer shown in FIG. 1, FIGS. 3A, 3B and 3C are graphs showing the operating characteristic of a CR motor, in which

DESCRIPTION OF THE PREFERRED EMBODIMENTS

Figure 1:
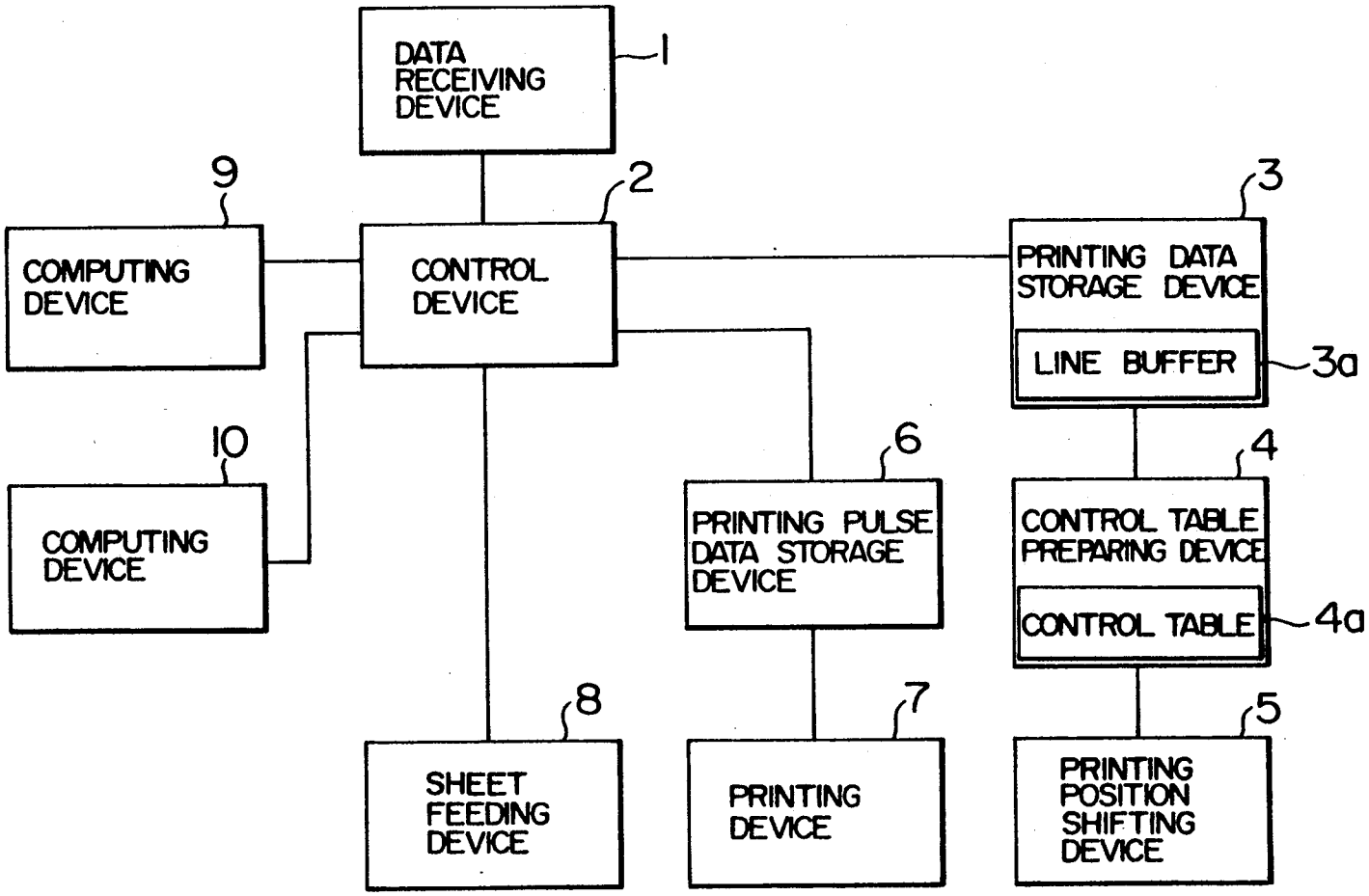
FIG. 1 is a functional block diagram of an embodiment of the printer according to the present invention.

FIG. 1 is a functional block diagram of a preferred embodiment of the printer according to the present invention.

Referring to FIG. 1, data receiving device 1 receives character data to be printed from, for example, a computer (not shown). Printing data storage device 3 includes a line buffer 3*a* storing character information to be printed on one line on a printing sheet (not shown), with character information received by the data receiving device 1 being stored in the line buffer 3*a*. Control table preparing device 4 prepares control information for driving a carriage (not shown) on the basis of the information stored in the line buffer 3*a*, and the control information thus prepared is stored in a control table 4*a*. Printing position shifting device 5 includes a carriage motor (not shown and abbreviated hereinafter as a CR motor) for moving the carriage, and the CR motor is driven according to data stored in the control table 4*a* thereby causing movement of the carriage. Printing pulse data storage device 6 produces printing pulse data or information for driving a plurality of pins of a printing head (not shown), and the printing pulse data thus produced is stored in a printing pulse data memory (not shown). Printing device 7 includes the printing head to execute printing by selectively projecting the pins from the printing head according to the printing pulse data stored in the printing pulse data memory. Sheet feeding device 8 includes a line feed motor (not shown and abbreviated hereinafter as an LF motor) to feed the printing sheet so as to change the line on which characters are to be printed. A first computing device 9 computes the period of time from the operation starting time to the operation stopping time of the LF motor. A second computing means 10 computes the period of time required until, after starting the operation starting time of the CR motor according to the control table 4*a*, a first printing pulse can be applied from the printing pulse data storage device 6 to the printing device 7. Control device 2 controls the printing data storage device 3, printing pulse data storage device 6, sheet feeding device 8 and first and second computing devices 9 and 10 according to data received by the data receiving device 1.

Figure 2:
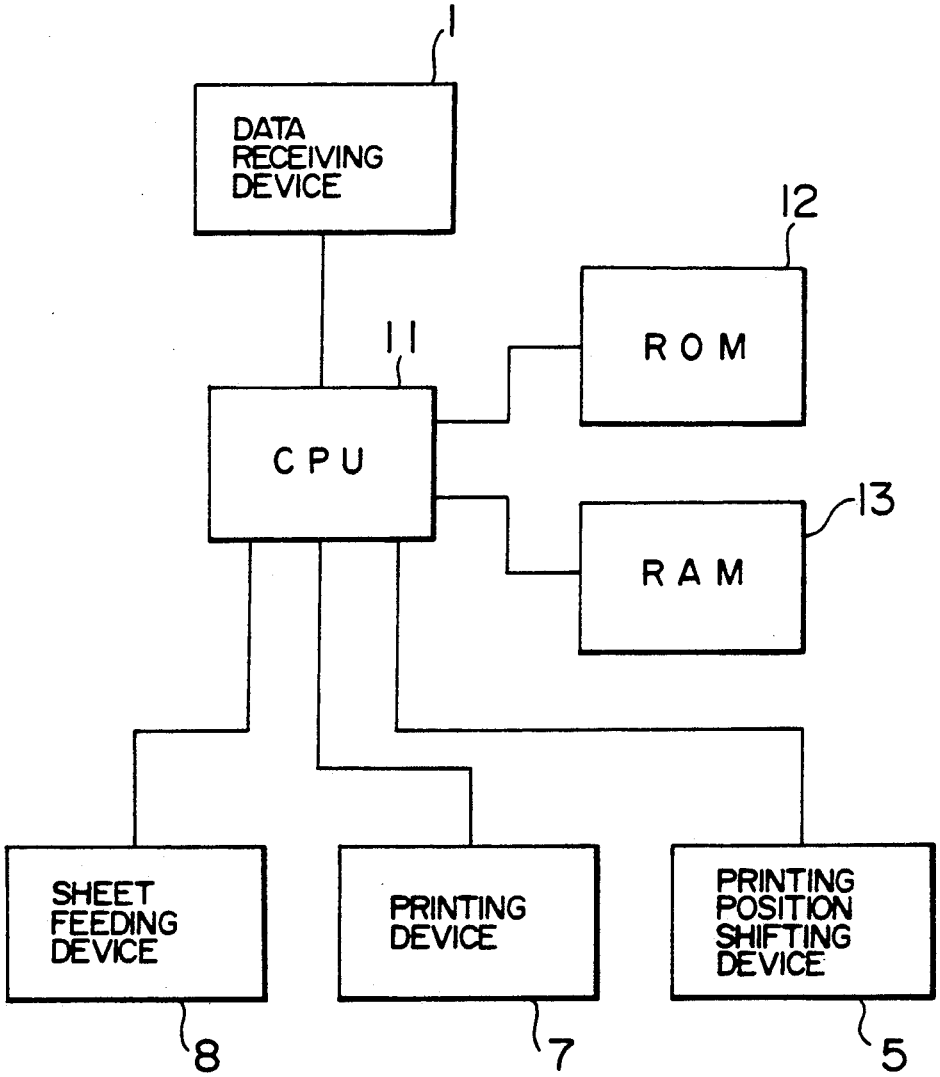

FIG. 2 is a system block diagram of the embodiment of the printer shown in FIG. 1. Referring to FIG. 2, a read-only memory 12 (abbreviated hereinafter as a ROM) and a random access memory 13 (abbreviated hereinafter as a RAM) are connected to a central processor unit 11 (abbreviated hereinafter as a CPU), to which the data receiving device 1, printing position shifting device 5, printing device 7 and sheet feeding device 8 shown in FIG. 1 are connected. The control device 2, printing data storage device 3, control table preparing device 4 and printing pulse data storage device 6 shown in FIG. 1 are embodied by the combination of the CPU 11, ROM 12 and RAM 13 shown in FIG. 2.

The operation of the carriage in the embodiment of the printer shown in FIG. 1 will now be described with reference to FIG. 3.

Figure 3A:
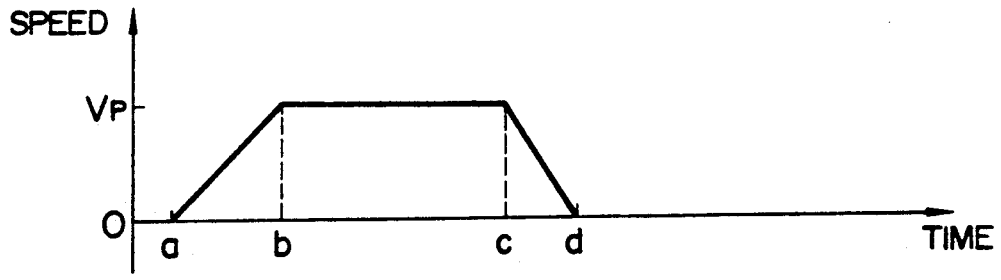
FIG. 3A shows how the speed of the CR motor changes in a normal starting operation pattern.

FIG. 3A is a graph showing a normal pattern of driving the carriage (which pattern will be referred to hereinafter as a normal starting operation pattern). Up to time a, the CR motor is held in a preparatory state in which the CR motor is ready to be accelerated (which state will be referred to hereinafter as a preparatory hold state). In a period a-b, the CR motor is accelerated until the carriage is moved at a speed $V_p$ (which will be referred to hereinafter as a predetermined printing speed) suitable for printing character data. Such acceleration will be referred to hereinafter as normal acceleration. In the next period b-c, the CR motor is rotating at a constant speed, and the carriage is also moving at the predetermined printing speed $V_p$. Upon completion of one-line printing operation, the carriage is decelerated in the next period c-d until the carriage is stopped at time d. Such deceleration will be referred to hereinafter as stopping operation.

Figure 3B:
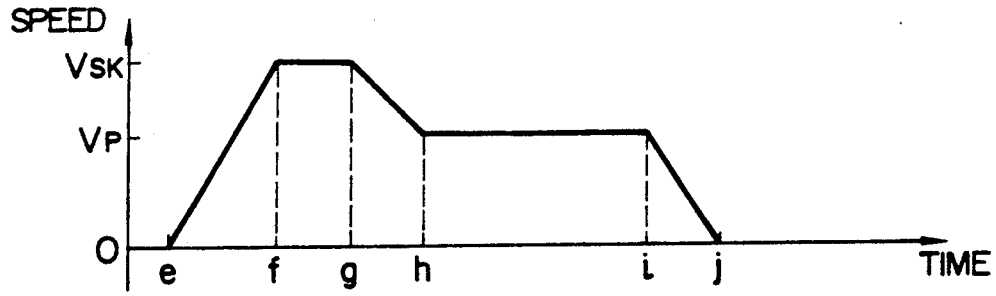
FIG. 3B shows how the speed of the CR motor changes in a high-speed starting operation pattern.

FIG. 3B is a graph showing a pattern of driving the carriage at a high speed (which pattern will be referred to hereinafter as a high-speed starting operation pattern). The carriage is driven according to such a pattern when the position of the carriage is remote from the next printing position on the printing sheet. The carriage is moved once at a high speed and is then decelerated to carry out printing by the printing head. Up to time e, the CR motor is placed in the preparatory hold state, and, in a period e-f, the CR motor is accelerated until the carriage is driven at a high speed $V_{SK}$. In the next period f-g, the carriage moves at the constant speed $V_{SK}$. Then, in the next period g-h, the carriage is decelerated down to the printing speed $V_p$, and printing by the printing head is carried out in the succeeding period h-i. Then, the carriage is deenergized in the next period i-j until it is stopped at time j.

Figure 3C:
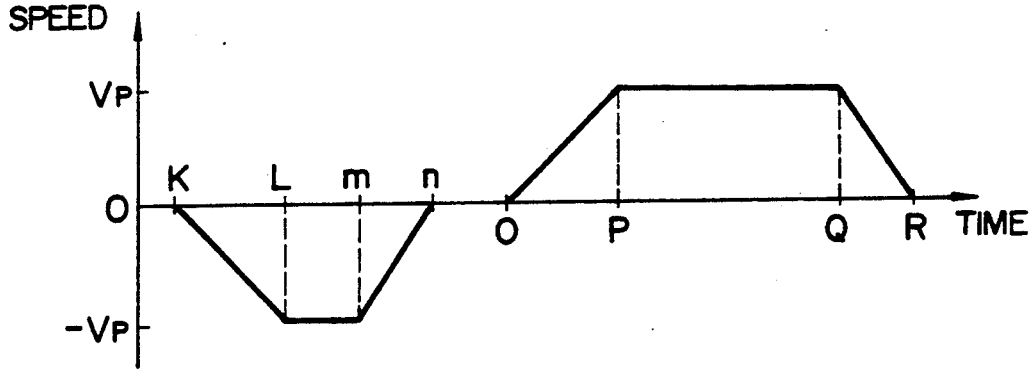
FIG. 3C shows how the speed of the CR motor changes in an inverted starting operation pattern.

FIG. 3C is a graph showing a pattern of driving the carriage when the carriage located at a position inside a printing zone is first moved to the outside of the printing zone at a constant speed and is then controlled to operate according to the normal starting operation pattern. The pattern shown in FIG. 3C will be referred to hereinafter as an inverted starting operation pattern. Up to time k, the CR motor is placed in the preparatory hold state, and, in a period k-l, the carriage is energized to move in the negative direction. Then, in the next period l-m, the carriage is moved at the constant speed $V_p$, and, in the next period m-n, the carriage is deenergized. Then, in the next period n-o, the CR motor is placed in the preparatory hold state so as to energize the carriage to move it in the positive direction. In the next period o-p, the carriage is energized to move in the positive direction, and, in the next period p-q, the carriage is moved at the predetermined printing speed $V_p$. Finally, in the period q-r, the carriage is deenergized until it is stopped at time r.

In the printer embodying the present invention, the control device 2 decides the range of data to be printed on one line on a printing sheet when a data input is applied from the data receiving device 1, and the data to be printed on one line is stored in the line buffer 3*a* of the printing data storage device 3. On the basis of the information stored in the line buffer 3*a* of the printing data storage device 3, the control table preparing device 4 selects one of the three drive patterns described above and decides that the carriage is to be moved according to the selected pattern. Thus, the control table 4*a* stores a sequence of the drive patterns according to which the carriage is to be moved.

Figure 4:
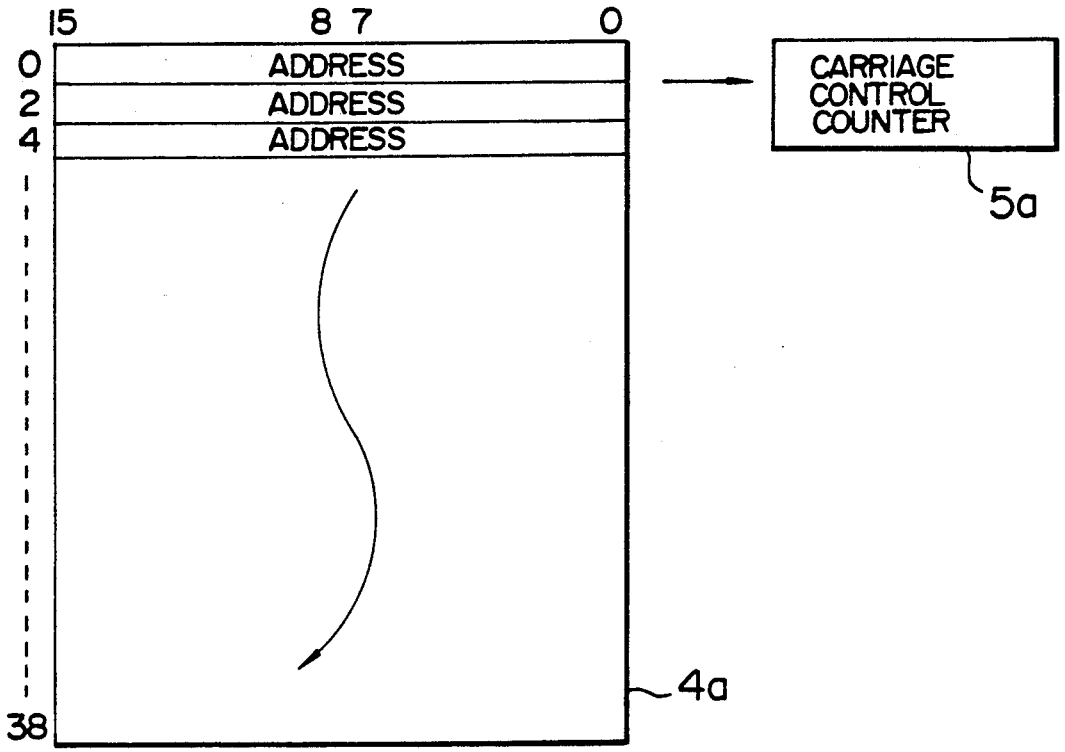
FIG. 4 is a schematic plan view showing the contents of the control table shown in FIG. 1.
Figure 5:
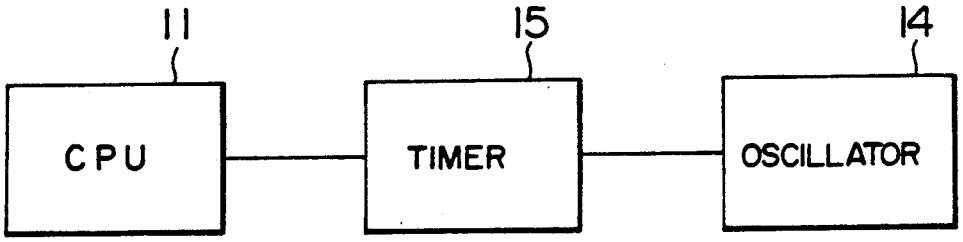
FIG. 5 is a system block diagram showing how an interrupt signal is applied to the CPU shown in FIG. 2.

As shown in FIG. 4, the address numbers in the ROM 12 are actually stored in the control table 4*a*, and, at each of the corresponding addresses of the ROM 12, control information for executing one of the drive patterns is stored. The CR motor is connected to a carriage control counter 5a. The control information stored in the ROM 12 is read out in the sequential order of the address numbers stored in the control table 4a, and the initial values are successively set in the carriage control counter 5a so as to drive the CR motor. Referring to FIG. 5, a timer 15 counts pulses generated from an oscillator 14. When the timer 15 counts a pre-set number of pulses, the timer 15 applies an interrupt pulse to the CPU 11, and, in response to the application of the interrupt pulse, the CPU 11 executes a subroutine of interrupt processing for deciding the pattern of the movement of the carriage.

The first computing device 9 computes the period of time required until a line feed operation is completed, and the second computing device 10 computes the period of time required until the CR motor is energized to permit printing by the printing head.

Figure 6:
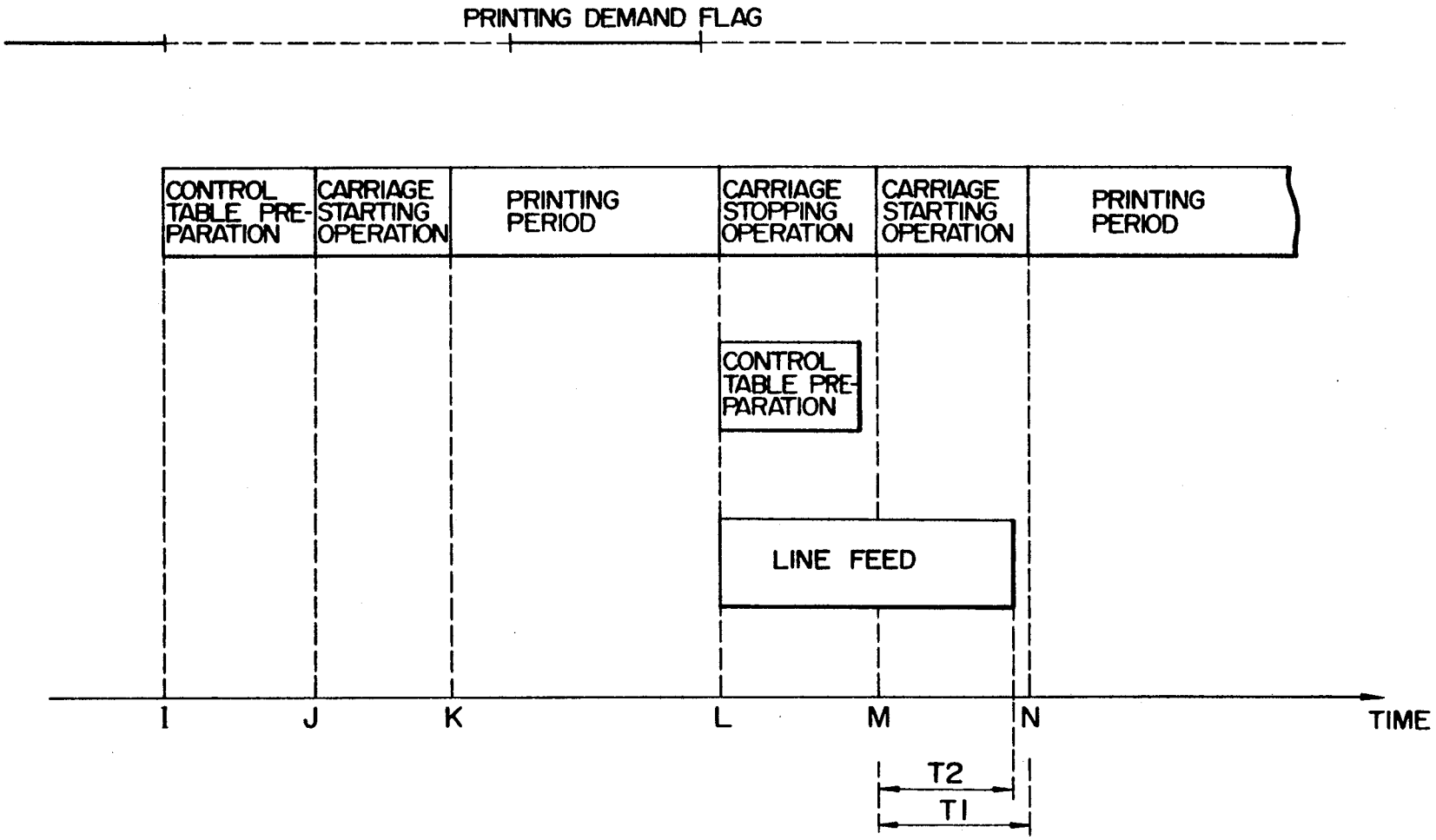
FIG. 6 is a timing chart showing the timing of the printing operation of the printer shown in FIG. 1.
Figure 7:
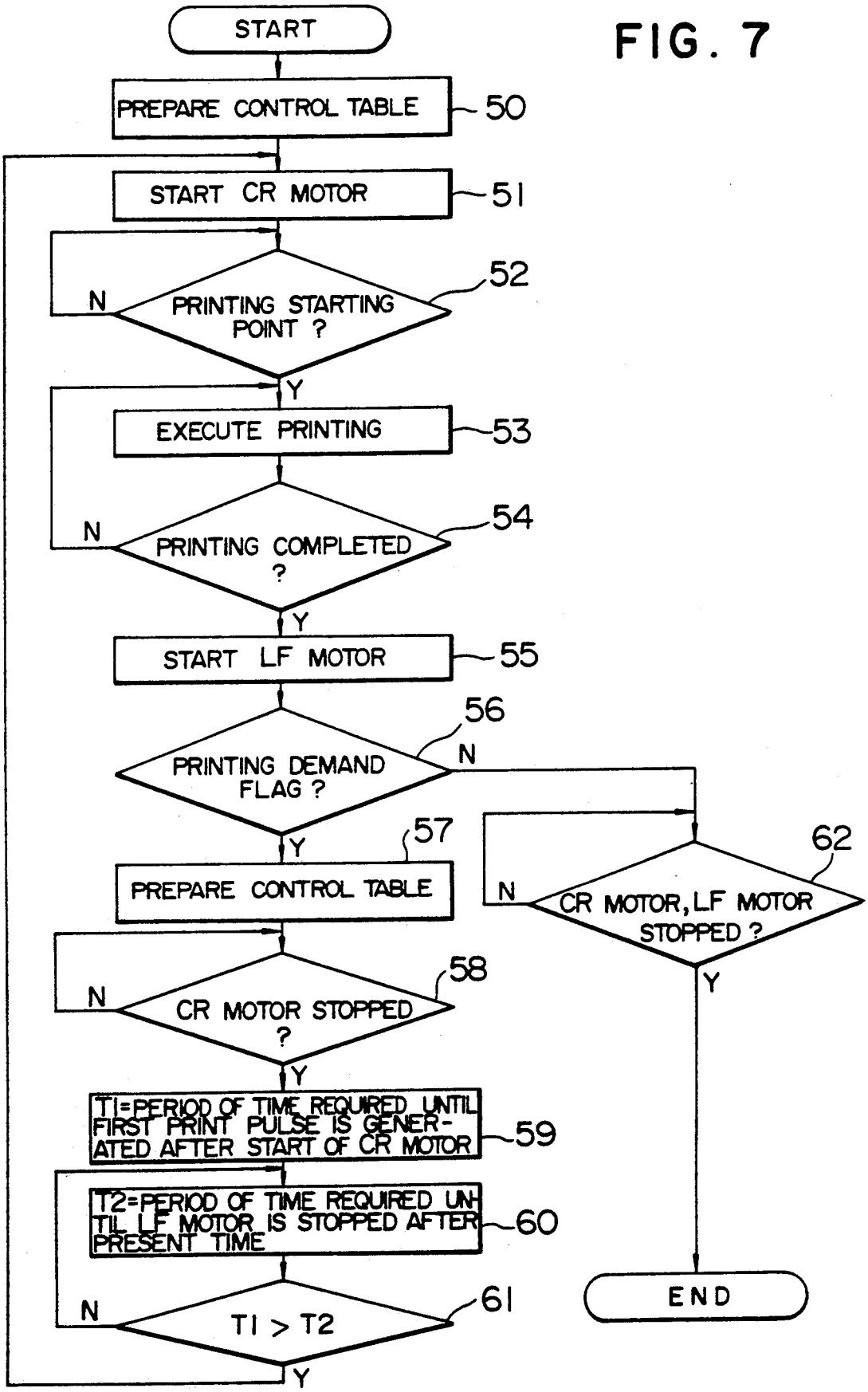
FIG. 7 is a flow chart showing the steps of a subroutine executed during the printing operation of the printer shown in FIG. 1.
Figure 8:
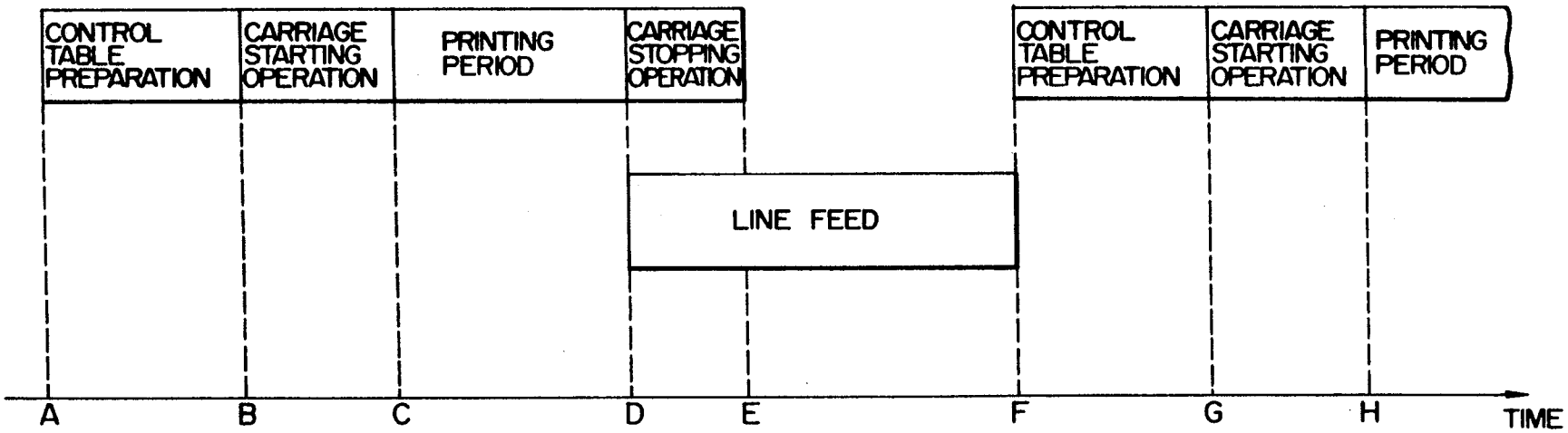
FIG. 8 PRIOR ART
FIG. 8 is a timing chart showing the timing of the printing operation of a prior art printer.

The operation of the printer having the above structure will now be described with reference to FIG. 6 which is a timing chart showing the timing of the printing operation and FIG. 7 which is a flow chart of the subroutine executed during the printing operation.

When now the data receiving device 1 receives information of character data to be printed from an external apparatus such as a computer, the control device 2 decides the range of data to be printed on one line on a printing sheet. Such printing data is temporarily stored in the line buffer 3a in the RAM 13, and a flag demanding printing the data is registered. In a step 50 in FIG. 7, the CPU 11 fetches from the line buffer 3a the information to be printed on one line, and, on the basis of this information, prepares control information to be stored in the control table 4a for controlling the movement of the carriage. (This step 50 corresponds to a period I-J in FIG. 6.) In the next step 51, energization of the CR motor is started according to the control information stored in the control table 4a, and, in the next step 52, whether or not the carriage has reached the printing starting point is decided. (The steps 51 and 52 correspond to a period J-K in FIG. 6.) When the result of decision in the step 52 is "YES", printing is executed in a step 53, and, in the next step 54, whether or not the printing of the data has been completed is decided. When the result of decision in the step 54 is "NO", printing is continued until all the data is completely printed. (These steps 53 and 54 correspond to a period k-L in FIG. 6.)

Immediately after the printing of the data is completed, rotation of the LF motor is started in a step 55 to feed the printing sheet until the printing position reaches the next line.

At the same time, a decision is made in a step 56 as to whether or not data to be printed on the next line has already been stored in the line buffer 3a and a flag demanding printing the data has been registered.

When the result of the decision in the step 56 proves that the flag has not been registered yet, the step 56 jumps to a step 62 where the series of printing operations comes to an end after both the CR motor and the LF motor are stopped.

On the other hand, when the result of decision in the step 56 proves that the flag has been already registered, control information for printing data on the next line is prepared and stored in the control table 4a in a step 57 on the basis of the information stored in the line buffer 3a. Then, in the next step 58, the CR motor is deenergized until it is completely stopped. (The steps 57 and 58 correspond to a period L-M in FIG. 6.)

Then, in a step 59, the first computing device 9 computes, according to the control information stored in the control table 4a, the period of time T1 required until the carriage reaches the printing starting position after energization of the carriage is started, and the computed value of T1 is supplied to the control device 2.

In a step 60, the second computing device 10 computes the period of time T2 required, from the present time, until the line feed by the LF motor is completed, and the vibration of the printing sheet caused by the line feed operation is completely attenuated, and the computed value of T2 is supplied to the control device 2.

At the time of applying a first printing pulse for printing the data on the next line, it is necessary that the line feed operation has already been completed, and the vibration of the printing sheet caused by the operation of the LF motor has been completely attenuated to place the printing sheet in a stable state. Therefore, the control device 2 compares the value of T2 with the value of T1 in a step 61, and the steps 60 and 61 are repeated until the relation $T1 > T2$ is satisfied.

At the time where the relation $T1 > T2$ is satisfied, energization of the CR motor is started again in the step 51 under control of the control device 2. (This time corresponds to time M in FIG. 6.) In the manner described above, the data is printed on the next line on the printing sheet.

The printer embodying the present invention is distinguished from the prior art printer in that the operation of the CR motor can be started without waiting for complete stoppage of the LF motor. Therefore, the overall printing speed of the printer is not affected at all by the period of time required for the line feed operation when this period of time required for the line feed is shorter than the period of time required for the starting and stopping operations of the carriage. Further, even when the period of time required for the line feed is longer than the period of time required for the starting and stopping operations of the carriage, an undesirable decrease in the overall speed of printing operation due to the operation required for the line feed can be minimized.

The present invention provides a printer comprising sheet feeding means for starting to feed a printing sheet to the position of the next line immediately after data of one line is completely printed and deceleration of a carriage from a predetermined printing speed is started, a control table preparing device for storing drive control information for the next line in a control table as soon as the data of the one line is completely printed and deceleration of the carriage from the printing speed is started, a first computing device for computing a first period of time required until the printing speed is attained again after acceleration of the carriage in a direction opposite to the direction of movement of the carriage during printing the data of the one line so that data of the next line can now be printed, a second computing device for computing, after the carriage is stopped, a second period of time required until the operation of the sheet feeding device is completed from the time of stoppage of the carriage, the second computing device continuing to compute the second period of time whenever the carriage is stopped, and a control device comparing the result of computation by the second computing device with the result of computation by the first computing device whenever the carriage is stopped, so that acceleration of the carriage is started again each time the result of computation by the second computing device becomes smaller than the result of computation by the first computing device. It will be understood from the feature of the present invention described above that, whenever the carriage is stopped after printing of data of one line, the period of time required for the starting operation of the carriage for printing data of the next line is compared with the period of time required until the line feed operation is completed, and the starting operation of the carriage is started at the time where the former period of time becomes longer than the latter period of time. Therefore, the overall speed of printing operation is not affected at all by the period of time required for the line feed operation when this period of time require for the line feed is shorter than the period of time required for the starting and stopping operations of the carriage. Further, even when the period of time required for the line feed is longer than the period of time required for the starting and stopping operations of the carriage, an undesirable decrease in the overall printing speed due to the operation required for the line feed can be minimized.

I claim:

1. A printer comprising:

a carriage carrying printing means and capable of reciprocating movement;

memory means for storing a plurality of carriage drive speed patterns;

a control table for storing address data for indicating a selected drive speed pattern for controlling driving of said carriage;

drive means for driving said carriage according to the selected drive speed pattern which is stored in said memory means and indicated by address data stored in said control table;

sheet feeding means for feeding a printing sheet, said sheet feeding means starting to feed a printing sheet to the position of a next line upon completion of printing of data of one line;

control table preparing means for causing the storage in said control table of the address data corresponding to a selected drive speed pattern stored in said memory means for the next line to be started upon completion of printing of data of one line;

first computing means for computing a first period of time required from the time when said carriage is stopped after the completion of printing of the data of the one line, until said carriage starts its movement and reaches a printing enable speed;

second computing means for sequentially computing, each time when said carriage is stopped after the completion of printing of the data of one line, a second period of time required from the time of stoppage of said carriage to the completion of the feeding operation of said sheet feeding means; and control means for comparing the second period of time computed by said second computing means with the first period of time computed by said first computing means whenever said carriage is stopped, and initiating acceleration of said carriage when the second period of time computed by said second computing means becomes less than the first period of time computed by said first computing means.

2. A printer comprising:

a carriage carrying printing means and capable of reciprocating movement;

memory means for storing a plurality of carriage drive speed patterns;

a control table for storing address data for indicating a selected drive speed pattern for controlling driving of said carriage;

drive means for driving said carriage according to the selected drive speed pattern which is stored in said memory means and indicated by address data in said control table;

sheet feeding means for feeding a printing sheet, said sheet feeding means starting to feed a printing sheet to the position of a next line simultaneously with the start of deceleration of said carriage from a predetermined printing speed upon completion of printing of data of one line;

control table preparing means for causing the storage of the address data corresponding to a selected drive speed pattern stored in said memory means, for the next line in said control table for moving said carriage in a direction opposite to the direction of movement of said carriage while printing the data of the one line, simultaneously with the start of deceleraton of said carriage from the predetermined printing speed upon completion of printing of the data of the one line;

first computing means for computing a first period of time required from the completion of printing of the data of the one line until said carriage starts its movement from its stopped state in the direction opposite to that while printing the data of the one line and reaches a printing enable speed;

second computing means for sequentially computing, each time said carriage is stopped after the completion of printing of the data of one line, a second period of time required from the time of stoppage of said carriage to the completion of the feeding operation of said sheet feeding means; and control means for comparing the second period of time computed by said second computing means with the first period of time computed by said first computing means whenever said carriage is stopped and initiating acceleration of said carriage each time the second period of time computed by said second computing means becomes less than the first period of time computed by said first computing means.

* * * * *